US008378591B2

(12) United States Patent
Van Herpen et al.

(10) Patent No.: US 8,378,591 B2
(45) Date of Patent: Feb. 19, 2013

(54) LIGHT OUTPUT DEVICE

(75) Inventors: Maarten Marinus Johannes Wilhelmus Van Herpen, Eindhoven (NL); Markus Cornelius Vermeulen, Nuenen (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 327 days.

(21) Appl. No.: 12/744,088

(22) PCT Filed: Nov. 24, 2008

(86) PCT No.: PCT/IB2008/054918

§ 371 (c)(1),
(2), (4) Date: May 21, 2010

(87) PCT Pub. No.: WO2009/069062

PCT Pub. Date: Jun. 4, 2009

(65) Prior Publication Data

US 2010/0244734 A1 Sep. 30, 2010

(30) Foreign Application Priority Data

Nov. 30, 2007 (EP) ..... 07121943

(51) Int. Cl.
*H05B 37/02* (2006.01)

(52) U.S. Cl. ..... 315/299; 307/12; 700/2

(58) Field of Classification Search ..... 315/291, 315/299; 307/11, 12; 700/2
See application file for complete search history.

(56) References Cited

U.S. PATENT DOCUMENTS 7,331,688 B2 * 2/2008 Peng ..... 362/228
7,465,056 B2 * 12/2008 Peng ..... 362/85
7,567,497 B2 * 7/2009 Gidon et al. ..... 369/126
2005/0253929 A1 11/2005 Kock
2006/0158882 A1 7/2006 Klomp et al.
2006/0197474 A1 9/2006 Olsen
2007/0015396 A1 1/2007 Mrakovich et al.
2007/0236156 A1 10/2007 Lys et al.
2007/0257632 A1 11/2007 Weigel
2007/0262726 A1 11/2007 Peng

FOREIGN PATENT DOCUMENTS

DE 10326368 A1 12/2004
WO 2007013003 A1 2/2007
WO 2008001274 A2 1/2008
WO 2008094366 A2 8/2008
WO 2008099305 A1 8/2008

(Continued)

OTHER PUBLICATIONS

"Expand Your Applications"; 4 Page Document Describing the Philips LED String System Lighting System, Document Order No. 3222 635 60071, May 2007 Koninklijke Philips Electronics N.V.

*Primary Examiner* — Thuy Vinh Tran
(74) *Attorney, Agent, or Firm* — Kenneth Springer; Mark Beloborodov

(57) ABSTRACT

A light output device comprises a power supply and a plurality of light source device arrangements arranged in a line extending from a power connection, with adjacent light source device arrangements in the line connected together with an electrical connector arrangement. Each light source device arrangement is associated with a control circuit from the plurality of control circuits for providing independent control of the light source device arrangement output based on the control signal. The device can be reduced in length by disconnecting the connector arrangement between an adjacent pair of light source device arrangements and the remaining light source device arrangements extending from the power source are independently controlled by the control signal.

13 Claims, 2 Drawing Sheets

FOREIGN PATENT DOCUMENTS

| | | | |
|---|---|---|---|
| WO | 2008114106 | A2 | 9/2008 |
| WO | 2008126003 | A1 | 10/2008 |
| WO | 2008129504 | A1 | 10/2008 |
| WO | 2009004563 | A1 | 1/2009 |

* cited by examiner

LIGHT OUTPUT DEVICE

FIELD OF THE INVENTION

This invention relates to light output devices, in particular using discrete light sources arranged as a string of devices.

BACKGROUND OF THE INVENTION

It is known to provide a string of light output devices, such as LEDs, and designed such that the "string" can be cut to any length. One end is connected to a power supply, in order to provide a decorative lighting product.

Devices of this type are used for signage, band lighting (e.g. petrol stations) and architectural applications, in which neon or fluorescent lighting would previously have been used. The string can be designed to be flexible, water resistant and robust. The LEDs are sealed devices, typically incorporating a heat sink and optics.

A problem with this type of device is how to control the on/off state and/or output level of individual light output devices in the string, while still enabling the string to be reduced in length.

SUMMARY OF THE INVENTION

According to the invention, there is provided a light output device comprising:

a power connection for connecting to a power source;

a plurality of light source device arrangements arranged in a line extending from the power connection, with adjacent light source device arrangements in the line connected together with an electrical connector arrangement comprising at least one power supply line and at least one power return line, the connector arrangement adapted to carry at least one control signal;

a plurality of control circuits, each light source device arrangement associated with a control circuit from the plurality of control circuits for providing independent control of the light source device arrangement output based on the control signal, wherein the device can be reduced in length by disconnecting the connector arrangement between an adjacent pair of light source device arrangements, wherein remaining light source device arrangements extending from the power source are independently controlled by the control signal.

The device of the invention uses micro controllers associated with the light source device arrangements in the string. A single data line (or data signal modulated over one of the power lines) can then be used to control the full string of light source device arrangements. The power supply line and the power return line can e.g. be wires.

At least one control circuit can comprise an input to which a drive signal is provided, an output for controlling the respective light source device arrangement, a control input for receiving a control signal and a control output for outputting a control signal. The circuit can then selectively couple a drive signal (a voltage or a current flow) to the light source device arrangement.

This enables control circuits to be coupled together using their control inputs and control outputs. In this way, they can be provided along a common control line (e.g. a wire) or set of control lines (e.g. wires), so that the control wires can be shared between the control circuits, or groups of control circuits.

The plurality of control circuits may be connected in a series, with the control output of one control circuit connected to the control input of the next control circuit. This enables a single data line to be used to control a group of light source device arrangements. The control signal is passed from circuit to circuit.

The control input of each control circuit is preferably adapted to receive a serial data signal and to control the switching of the drive signal to the output in dependence on one or more bits of the serial data signal. In this way, a serial data signal can be passed from control circuit to control circuit using a shared control signal line, to effect control of the multiple control circuits. For example, the control output of each control circuit can be adapted to output a serial data signal from which the one or more bits of the serial data signal have been removed. Thus, each control circuit responds to pre-allocated parts of the serial control word, and then removes these parts of the control word so that the next controller can respond to its control signal.

The power supply line can carry a current source output current, and this means the light source device arrangements and associated control circuits can be connected in series along the power supply line. Even when the string is cut to length, the brightness of the remaining light source device arrangements will be unchanged. The end of the line then preferably comprises a connector which connects the power supply line and the power return line, so that a current return path is provided.

Alternatively, the power supply line can carry a drive voltage. The light source device arrangements and associated control circuits can then be connected in parallel between the power supply line and power return line.

Each control circuit can comprise a microcontroller.

The electrical connector arrangement can comprise a control line for the control signal in addition to the power supply line and power return line, or else the control signal is provided (modulated) on one of the power lines.

It is noted that the invention relates to all possible combinations of features recited in the claims.

BRIEF DESCRIPTION OF THE DRAWINGS

Examples of the invention will now be described in detail with reference to the accompanying drawings, in which.

The same reference numbers are used to denote similar parts in the different figures.

DETAILED DESCRIPTION OF EMBODIMENTS

The invention provides a light output device where each light source device arrangement is associated with a microcontroller. The microcontroller controls the on/off state of the light output device.

Figure 1:
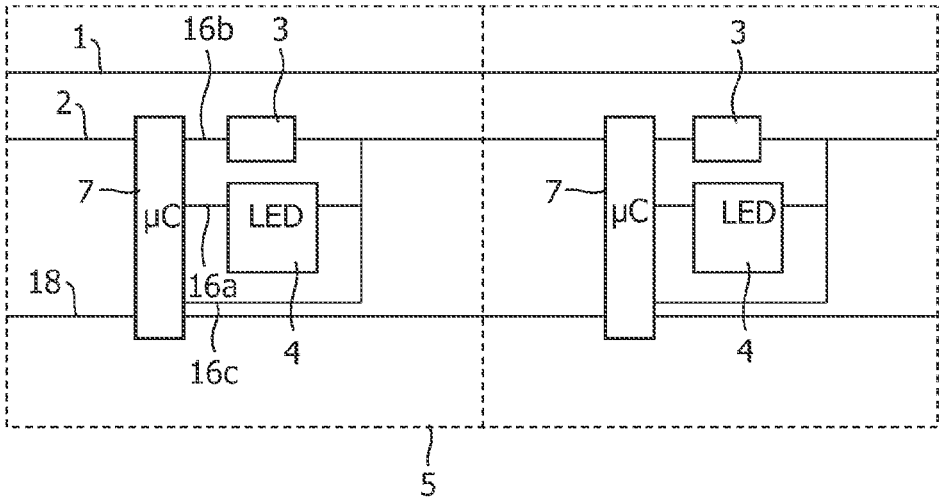
FIG. 1 shows a first example of light output device of the invention.

FIG. 1 shows a first example of device of the invention. In this example, the light source device arrangements are LEDs. The LED string comprises several unit cells 5, which are indicated with a dashed line in FIG. 1. Each unit cell 5 comprises two power lines in the form of wires 1 and 2, an LED 4 (or a group of LEDs 4), a resistor 3, a microcontroller 7 and a data line in the form of wire 18. The power wire 1 is the return line and the power wire 2 is the supply line.

The microcontroller 7 is controlled by a signal on the data wire 18. As shown in FIG. 1, an output from one microcontroller 7 is supplied to the input of the next microcontroller in the string, so that the microcontrollers are connected together in series.

In this example, the microcontroller has two power outputs, 16*a* and 16*b*, and the function of the microcontroller is essentially to couple a drive signal (current or voltage) from the power wire 2 to a selected one of the power outputs 16*a*, 16*b*.

Thus, based on the input provided on the data wire 18, the microcontroller 7 will transfer power from power wire 2 to wire 16*a* or wire 16*b*. Wire 16*a* functions as the power source for the LED 4, so that when power is supplied to 16*a*, the LED 4 will be turned on.

When power is supplied to wire 16*b*, the resistor 3 is supplied with power, such that the voltage difference stays constant. This resistor may not be required, in which case when an LED is not selected, the current simply bypasses the LED.

In alternative embodiments, a bypass mechanism can be used to short-circuit the LED, either continuously or intermittently. An intermittent short circuit function can be used as a way of providing dimming, without breaking the current path on power wire 2. This bypass mechanism is not shown in FIG. 1.

Additional connections may be made in order to supply the microcontroller 7 with supply voltage or reference voltages. For example, the wire 16*c* shown in FIG. 1 supplies the microcontroller with a reference voltage for the power supply.

In the example of LED devices, these are current-driven devices. As a result, the LEDs can receive their power from a central current source which supplies the power wire 2. By using a current source, all series-connected LEDs (such as the LEDs in FIG. 1) will be driven by the same current and will therefore have the same brightness. The number of LEDs in the chain will not influence the brightness. There is of course a need for the current source power supply to have sufficient power/voltage that the on-current can be driven through the maximum number of series-connected LEDs.

The microcontroller is powered by power wire 1 or 2, which is present in each module.

The data received by the microcontroller through data wire 18 is forwarded to the next microcontroller in the string. Preferably, the microcontroller 7 modifies this data such that the next microcontroller knows where in the string it is located and what part of the data should to be used. For example, every microcontroller might use the first data symbol, and it forwards the full data string excluding the first symbol.

Figure 2:
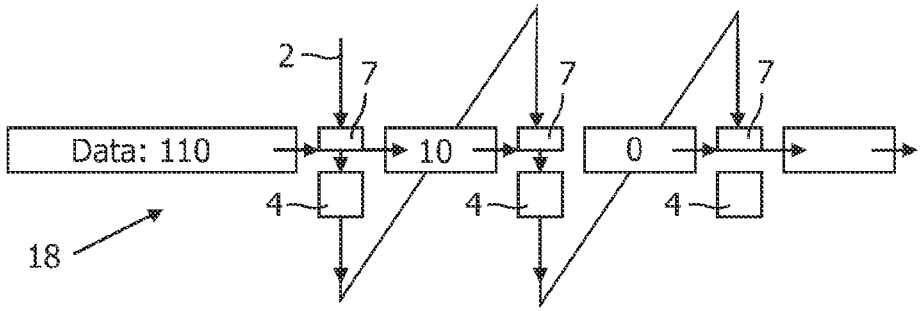
FIG. 2 shows how the control circuits can be controlled.

FIG. 2 shows in more detail how a string of data "110" is input to data wire 18 and interpreted by the microcontrollers. The first microcontroller 7 uses the first symbol in this string "1" to determine that its corresponding LED 4 should be turned on. The microcontroller removes the first item in the data string, and forwards the remaining data "10" to the next microcontroller using the its control output, which defines the continuation of the data wire 18. Similarly, the next microcontroller turns the LED on, and forwards the data "0" to the final microcontroller, which turns its LED off.

In this embodiment, only one data wire 18 is shown. However, multiple data wires 18, or a combination of a data wire and a low power supply for the microcontroller may be used.

As an example of a microcontroller, a 6-Pin, 8-Bit Flash Microcontroller can be used, for example PIC10F200/202/204/206 by Microchip Technology Inc.

In the example of FIG. 1, the two power wires 2 and 1 act as a supply line and a return line. The current source power source is connected between wires 1 and 2, and an end-connector is required at the end of the string between the power wires 1 and 2.

Figure 3:
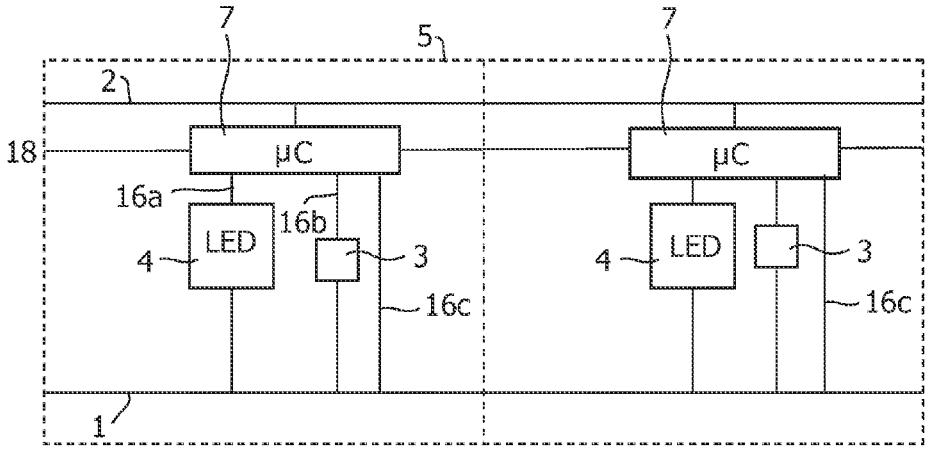
FIG. 3 shows a second example of light output device of the invention.

Because the structure in FIG. 1 is comprised of unit cells, the string may be reduced in length without disabling the control with the micro controllers. In FIG. 1 the unit cells 5 are connected in series. However, it is also possible to connect unit cells in parallel. This is shown in FIG. 3.

In this example, each microcontroller controls the switching of power from the power wire 2, and the power wire 2 connects in parallel to each microcontroller 7. Two outputs 16*a*, 16*b* from the microcontrollers are in parallel to the return power wire 1.

An advantage of a parallel connection approach is that failure of one LED does not lead to problems for the other LEDs.

In this example, the power wire 2 can be voltage driven, as the same voltage will be applied across all LEDs. In this example the wire 16*a* is connected to the LED. In an alternative embodiment the wire 16*a* may be connected to a combination of a LED+resistor, in order to make the operation of the LED more stable when connected in parallel with other LEDs.

The wire 16*c* is used as power supply for the microcontroller.

The unit cells in FIG. 3 are in parallel, but the same series connection of the data wire 18 to the microcontrollers is provided.

Figure 4:
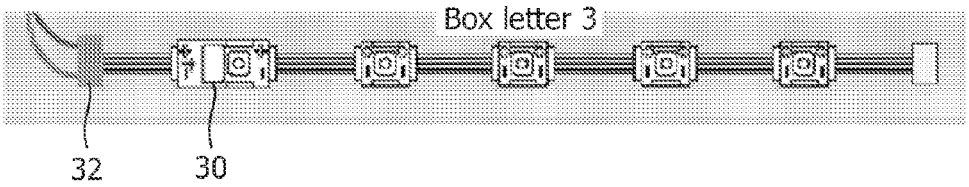
FIG. 4 shows the appearance of an example of the overall product.

FIG. 4 shows an arrangement which provides a mixture of parallel and series connections. The first element 30 in this string is shown as larger, indicating the start of a parallel connection. The next four LED circuits are in series. This hybrid solution allows the supply voltage over the supply wires to be higher than that of a single LED 4, as they supply a set of series-connected LEDs (a set of four in this example). The system may nevertheless be reduced in length. FIG. 4 also shows schematically the power course and master controller 32 which generates the control signal for the local individual LED control circuits and provides the drive signal.

FIG. 4 shows only one branch, and multiple branches such as shown in FIG. 4 can be connected together in parallel.

The microcontroller and the LED can be merged into a single discrete device. As mentioned above, the microcontroller can also be used to control the light intensity of the LED. This may for example be achieved using the microcontroller to implement local pulse-width modulation at the position of the LED.

In an alternative example, brightness control can be implemented using a microcontroller with several output connectors having a different resistance. For voltage driven applications (such as FIG. 2), different output resistances from the controller 7 can be used to provide different voltage drops, and corresponding changes in the LED drive voltage and output brightness.

Optionally, the data wire 18 can be eliminated by superimposing the control signal on another wire, such as the power wire 2. This can enable the invention to be implemented using an existing LED string, so that the system of the invention is backward compatible with existing LED strings.

In general, the microcontroller 7 may be any electrical component comprising allowing a power supply input to be selectively routed (based on a control input) to an output, for driving the LED. Preferably, there is a second output for bypassing the LED. For example, a simplified device can comprise a transistor connected to the data wire 18. The data wire then selectively switches the transistor on or off, and thereby effects switching between a power wire common input and an output which drives the LED.

Each light source device arrangement may comprise a single light source or multiple light sources. A light source may comprise a single LED or multiple LEDs and one control circuit may control multiple light sources. Other types of light sources may also be used. When one control circuit is for multiple light sources, they may be different colors, for example red, green and blue, thus defining color sub-pixels of a single color light source.

In the examples above, the control circuit is for controlling brightness. Another function of the control circuit may be a programmed sequence of on/off states. For example, the control circuit may be instructed to let the LED blink on/off with a period of 1 second. Alternatively, it may be instructed to randomly turn the LEDs on/off with a predetermined average frequency (e.g. 1 Hz). Alternatively, it may be instructed with a sequence of on/off states which it will keep playing from the start of this sequence.

Thus, the control circuits can be used to implement a variety of programmable optical functions and effects. A lighting controller for the overall device is provided for controlling these effects, for controlling the signals provided to the individual control circuits.

Various modifications will be apparent to those skilled in the art.

The invention claimed is:

1. A light output device comprising:

a power connection for connecting to a power source;

a plurality of light source device arrangements arranged in a line extending from the power connection, with adjacent light source device arrangements in the line connected together with an electrical connector arrangement comprising at least one power supply line and at least one power return line, the connector arrangement adapted to carry at least one serial data signal; and a plurality of control circuits, each light source device arrangement associated with a control circuit from the plurality of control circuits for providing independent control of the light source device arrangement output based on the serial data signal, wherein when the connector arrangement between an adjacent pair of light source device arrangements is disconnected, one or more remaining light source device arrangements extending from the power source are independently controlled by the serial data signal;

wherein each control circuit comprises:

an output to which a drive signal is provided, an output configured to control the respective light source device arrangement, a control input configured to receive the serial data signal and to control a switching of the drive signal to the output in dependence on one or more bits of the serial data signal, and a control output configured to output the serial data signal from which the one or more bits have been removed.

2. The device of claim 1, wherein each light source device arrangement comprises a plurality of light source devices.

3. The device of claim 1, wherein the plurality of control circuits are connected in a series, with the control output of one control circuit connected to the control input of a next control circuit.

4. The device of claim 1, wherein the power supply line carries a current source output current.

5. The device of claim 1, wherein the light source device arrangements and associated control circuits are connected in series along the power supply line.

6. The device of claim 1, further comprising a connector which connects the power supply line and the power return line.

7. The device of claim 1, wherein the power supply line carries a drive voltage.

8. The device of claim 1, wherein the light source device arrangements and associated control circuits are connected in parallel between the power supply line and power return line.

9. The device of claim 1, wherein the light source device arrangements and associated control circuits are connected as a plurality of parallel branches, with each branch comprising a plurality of source device arrangements and associated control circuits connected in series along the power supply line.

10. The device of claim 1, wherein each control circuit comprises a microcontroller.

11. The device of claim 1, wherein the electrical connector arrangement comprises a control line (18) for the control signal in addition to the power supply line and power return line.

12. The device of claim 1, wherein the control signal is provided on one of the power supply line and power return line.

13. The device of claim 1, wherein the serial data signal comprises a series of bits, and wherein the one or more bits in dependence on which the control input is configured to control the switching of the drive signal comprise a first bit which is first in sequence in the series of bits, and wherein each control circuit is configured to remove the first bit which it uses to control the switching of the drive signal, and to output the serial data signal with the first bit removed.

* * * * *